US008746223B2

(12) United States Patent
Jones

(10) Patent No.: US 8,746,223 B2
(45) Date of Patent: Jun. 10, 2014

(54) ARCHERY RELEASE

(75) Inventor: Brian K. Jones, Winchester, KY (US)

(73) Assignee: Scott Archery LLC, Henrietta, NY (US)

( * ) Notice: Subject to any disclaimer, the term of this patent is extended or adjusted under 35 U.S.C. 154(b) by 177 days.

(21) Appl. No.: 13/343,908

(22) Filed: Jan. 5, 2012

(65) Prior Publication Data

US 2013/0174821 A1 Jul. 11, 2013

(51) Int. Cl.
*F41B 5/18* (2006.01)

(52) U.S. Cl.
USPC ..... 124/35.2

(58) Field of Classification Search
USPC ..... 124/35.2
See application file for complete search history.

(56) References Cited

U.S. PATENT DOCUMENTS

| | | | | |
|---|---|---|---|---|
| 228,302 | A | 6/1880 | Beard | |
| 229,089 | A | 6/1880 | Burnham | |
| 3,954,095 | A | 5/1976 | Lewis | |
| 4,036,204 | A | 7/1977 | Scott | |
| 4,160,437 | A | 7/1979 | Fletcher | |
| 4,567,875 | A | 2/1986 | Fletcher | |
| 4,574,767 | A | 3/1986 | Gazzara | |
| 4,620,523 | A | 11/1986 | Peck | |
| 4,674,469 | A | 6/1987 | Peck | |
| 4,881,516 | A | 11/1989 | Peck | |
| 5,205,268 | A | 4/1993 | Savage | |
| 5,261,581 | A | 11/1993 | Harden, Sr. | |
| 5,448,983 | A | 9/1995 | Scott | |
| 5,595,167 | A | 1/1997 | Scott | |
| 5,596,977 | A | 1/1997 | Scott | |
| 5,615,662 | A * | 4/1997 | Tentler et al. | 124/35.2 |
| 5,653,214 | A * | 8/1997 | Lynn | 124/35.2 |
| 5,765,536 | A | 6/1998 | Scott | |
| 5,803,068 | A | 9/1998 | Summers | |
| 5,850,825 | A * | 12/1998 | Scott | 124/35.2 |
| 5,937,841 | A * | 8/1999 | Summers et al. | 124/35.2 |
| 6,032,661 | A | 3/2000 | Goff et al. | |
| 6,631,709 | B2 | 10/2003 | Carter et al. | |
| 6,895,951 | B2 | 5/2005 | Summers et al. | |
| 7,278,415 | B2 | 10/2007 | Jones | |
| D597,164 | S | 7/2009 | Jones | |
| 7,753,043 | B1 | 7/2010 | Eckert | |
| 7,926,475 | B2 | 4/2011 | Jones | |
| 7,946,282 | B2 | 5/2011 | Jones | |
| 2003/0230295 | A1 * | 12/2003 | Jones | 124/35.2 |
| 2010/0108047 | A1 | 5/2010 | Jones | |

OTHER PUBLICATIONS

Various prior art releases (1) downloaded from http://www.archeryhistory.com/releases/releasespics/pse.jpg on Dec. 29, 2009.

(Continued)

*Primary Examiner* — John Ricci
(74) *Attorney, Agent, or Firm* — Hiscock & Barclay, LLP

(57) ABSTRACT

An archery release including a release body, a wrist strap and a hybrid adjuster including both a rigid length adjuster and a flexible length adjuster which enable multiple levels of adjustment to the distance between the wrist strap and the release body. An archery release also is provided including a release body, a wrist strap and a retainer element configured to engage and secure the release body in a stowed position proximate the wrist strap when the archery release is not in use. A method also is provided for operating an archery release including the retainer element to stow the release body.

23 Claims, 6 Drawing Sheets

(56) References Cited

OTHER PUBLICATIONS

Various prior art releases (2) downloaded from http://www.archeryhistory.com/releases/releasespics/release4.jpg on Dec. 29, 2009.

Prior art releases (3) downloaded from http://www.archeryhistory.com/releases on Jul. 21, 2011.

Prior art releases (4) downloaded from http://www.archeryhistory.com/releases on Jul. 21, 2011.

Longhorn Hunter (2010).

* cited by examiner

ARCHERY RELEASE

BACKGROUND OF THE INVENTION

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases are intended to consistently release the bowstring when the archer shoots the arrow, and thus increase the accuracy of the shot.

Most releases include a head having one or more pivotable jaws that hold the bowstring, a trigger mechanism that actuates the jaws, and a wrist strap or handle configured so that a archer can hold the release. In use, an archer nocks an arrow on the bowstring and secures the jaws of the release around the bowstring or an associated loop. The archer then draws the bowstring by pulling the release. After the archer fully draws the bowstring, aims the bow and is prepared to shoot the arrow, the archer actuates the trigger mechanism. This moves the one or more jaws and subsequently disengages the bowstring so that the bowstring can utilize its stored energy and propel the arrow from the bow.

Some releases also include either one of two completely different adjustment mechanisms configured to accommodate the physical attributes of an archer, for example, hand size, draw length and finger length and the like. The first adjustment mechanism is referred to as a rigid or solid multi-hole adjuster. This rigid adjuster usually is formed as part of the release head, and includes a fastener that can be positioned in any one of multiple holes. By positioning the fastener in a preselected hole, an archer can fix the distance of the release head from a wrist strap in a desired configuration. One such adjustment system is disclosed in U.S. Pat. No. 5,850,825 to Scott.

An issue with rigid adjusters, however, is that they usually are rigidly attached at a pivot pin to another rigid plate on the wrist strap. Thus, the entire release body and adjuster are constrained to a limited range of movement within a plane common to the rigid plate. This, in turn, can prevent the release body from being precisely positioned according to the archer's preference. This construction also can place the release body in an undesirable forward facing position when the release is not in use, and the archer is engaged in another activity, such as reloading an arrow, adjusting a sight or other archery accessory, or climbing a tree.

The second, competing and different adjustment mechanism is referred to as a flexible adjuster. This adjuster typically is in the form of a nylon web that is connected at one end directly to a release head and at an opposing end directly to a wrist strap. The flexible adjuster is joined to the wrist strap with a clamp so that the length of the web between the strap and head can be adjusted as desired by the archer. One such adjustment system is disclosed in U.S. Pat. No. 7,278,415 to Scott.

An issue with flexible adjusters, however, is that they inhibit the archer from reproducibly selecting a desired distance between the release head and the wrist strap. Flexible adjusters also are typically connected to a diminutive release head, which can be undesirable to some archers desiring a larger head. Further, flexible adjusters, when not in use, typically dangle the release head freely from an associated wrist strap. When the archer is engaged in another activity, such as reloading an arrow, adjusting a sight or other archery accessory, or climbing a tree, the release head and adjuster can interfere with the other activity.

SUMMARY OF THE INVENTION

An archery release in one embodiment is provided including a release body, a wrist strap and a hybrid adjuster including both a rigid length adjuster and a flexible length adjuster which enable precise adjustment of the distance between the wrist strap and the release body.

An archery release in another embodiment is provided including a release body, a wrist strap and a retaining element configured to engage and secure the release body in a stowed position proximate the wrist strap when the archery release is not in use.

In another embodiment, the rigid length adjuster and the flexible length adjuster are joined with an adjuster linking element. Optionally, the adjuster linking element can include a swivel so that the release body and/or rigid length adjuster can rotate relative to the adjuster linking element and/or the flexible length adjuster.

In still another embodiment, the rigid length adjuster can include an inner adjustment element and an outer adjustment element. One of the elements can define a plurality of holes and the other of the elements can define a primary hole. The rigid length adjuster can also include a fastener that can be placed at least partially through any one of the plurality of holes and at least partially through the primary hole. In such an arrangement, the effective length of the adjuster can be set by the archer, optionally at some incremental length, due to the fixed location of the holes in the respective inner and outer adjustment elements.

In yet another, further embodiment, the flexible length adjuster can include a flexible tether that enables the flexible length adjuster to flexibly join the release body and/or rigid length adjuster to the wrist strap, so that those components can be configured at an infinite number of orientations relative to the wrist strap.

In even another embodiment, the flexible length adjuster can include an adjustment element adapted to change the length of the flexible tether, and thereby change the distance between the release body and the wrist strap. The effective length of this adjuster can be set by the archer, optionally at some variable length, due to the infinite number of lengths of the tether that can be selected.

In a further embodiment, the rigid length adjuster and flexible length adjuster can be individually and selectively configurable to set the lengths of each, and thereby set the distance between the release body or some portion thereof and the wrist strap.

In still a further embodiment, the retainer element can be joined with the wrist strap. The retainer element can be constructed from a resilient material, and optionally can be in the form of a band that circumferentiates the wrist strap. The retainer element can define a retaining area within which the release body can be at least partially inserted in use. The retainer element can secure the release body or some portion thereof in the retaining area, and generally to the wrist strap in a stowed mode when the release is not in use.

A simple and efficient archery release is provided that enables an archer to precisely and consistently customize the release to the archer's physical stature and performance needs. Where the release includes a first and second adjuster, it can provide both rigid length adjustment and flexible length adjustment in a single construction. Where the release includes a retainer element, it can cleanly stow the release body or some other portion of the release out of the way when the release is not in use, and when the archer is engaged in another activity.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENTS

I. Overview and Definitions

Figure 1:
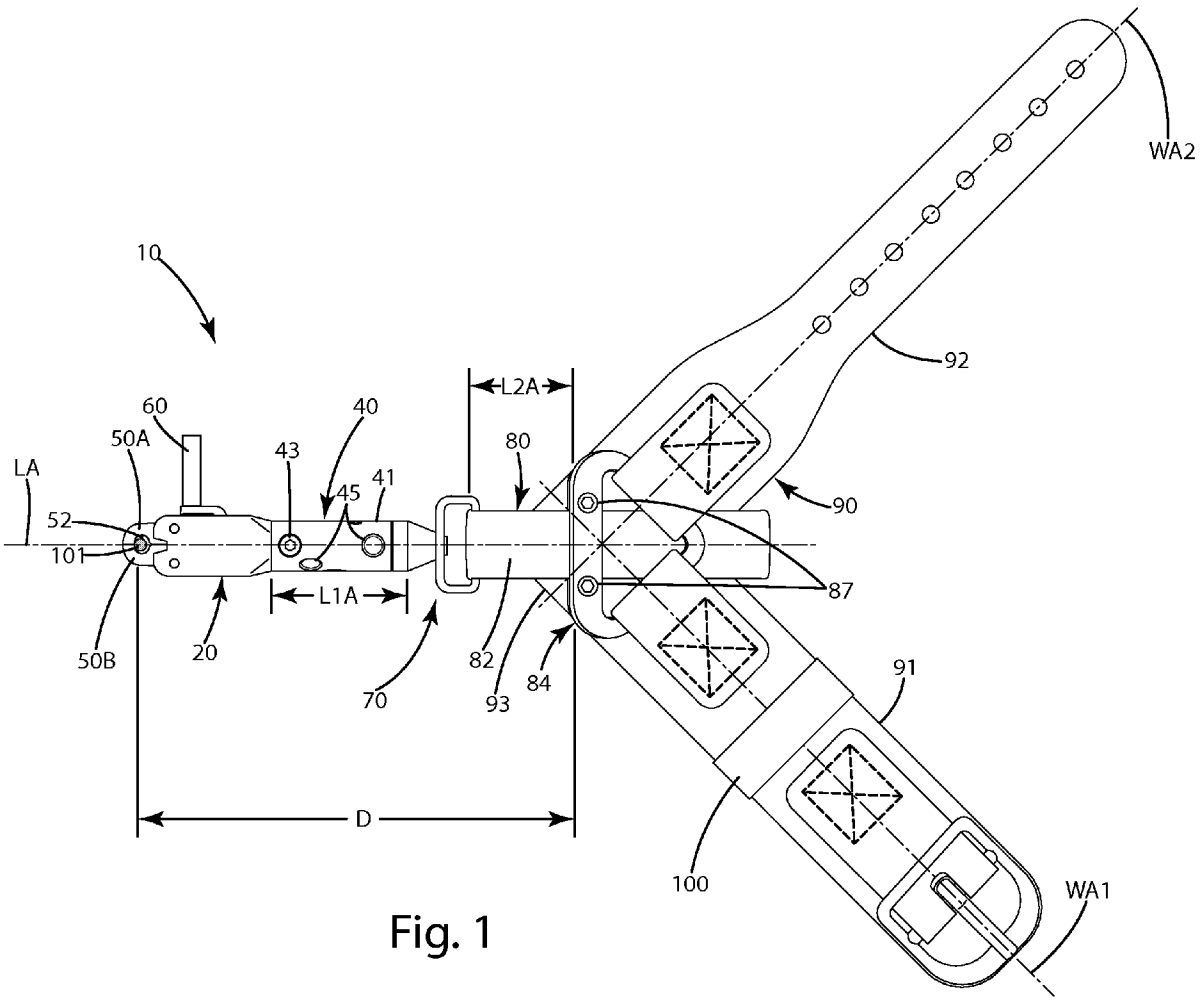
FIG. 1 is a top view of the archery release of a current embodiment in a closed position and in a fully retracted mode.
Figure 2:
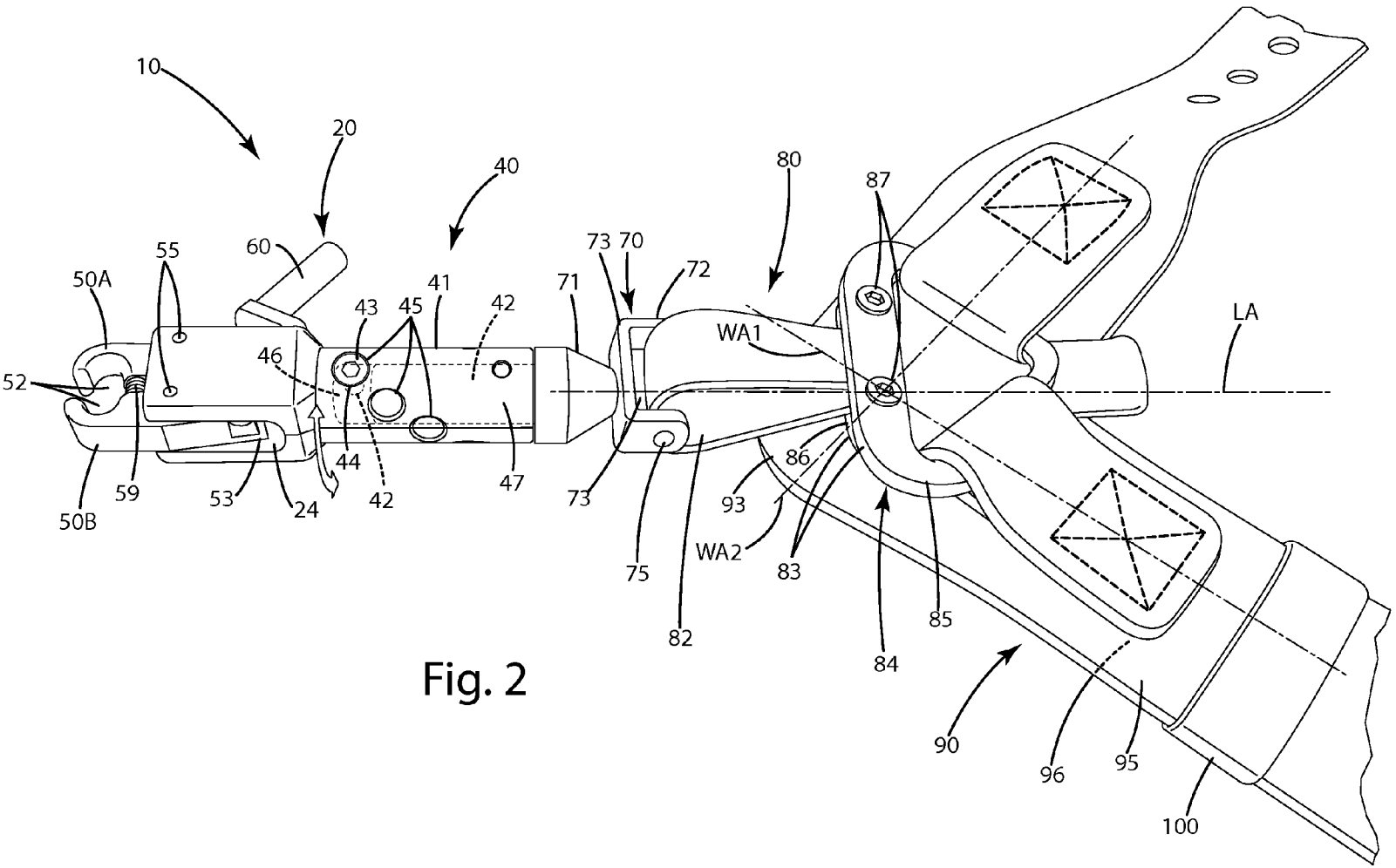
FIG. 2 is a perspective side view of the release in an open position and in a fully retracted mode.
Figure 3:
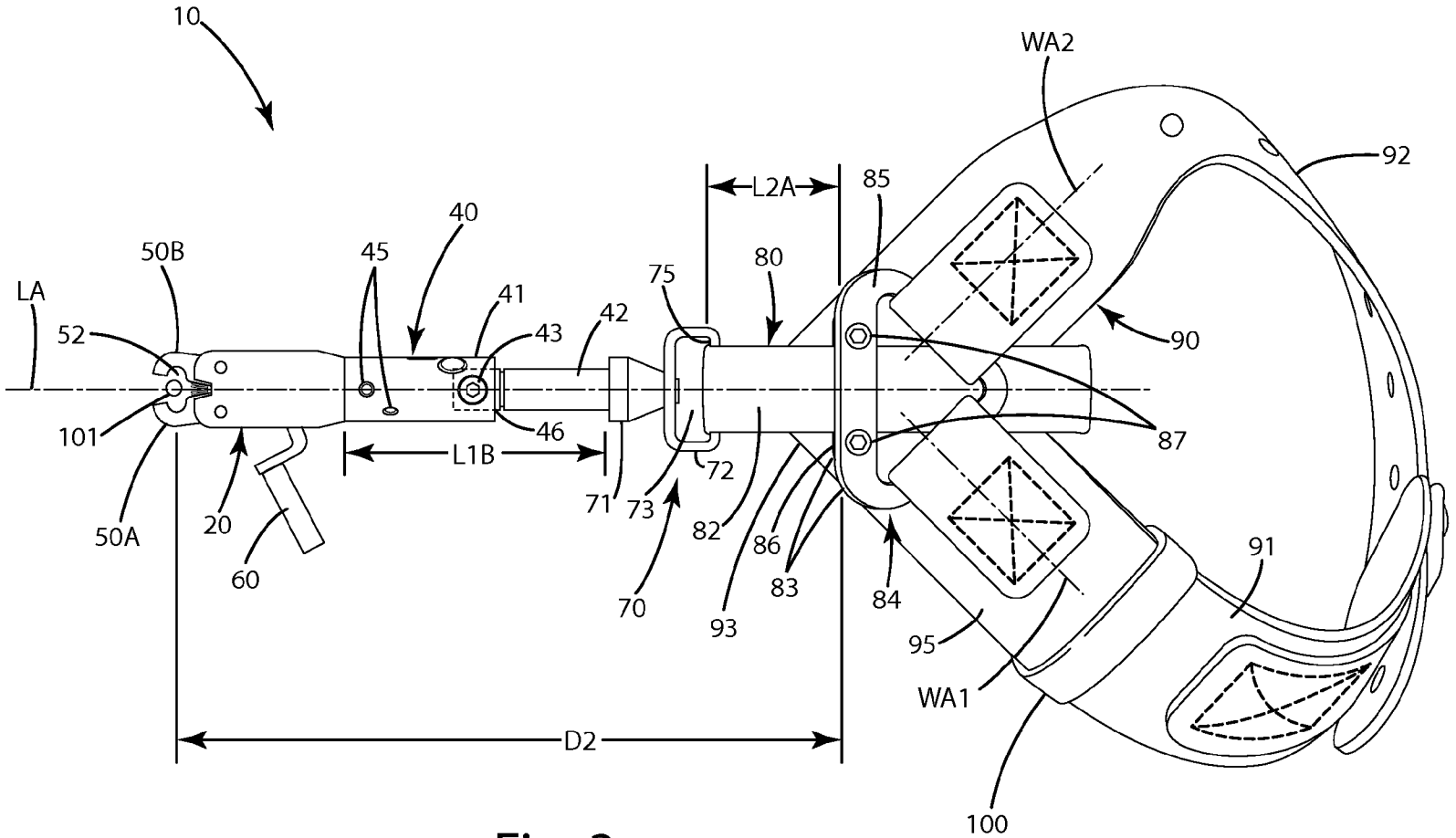
FIG. 3 is a top view of the release with a rigid adjuster in an extended mode and a flexible adjuster in a retracted mode.
Figure 5:
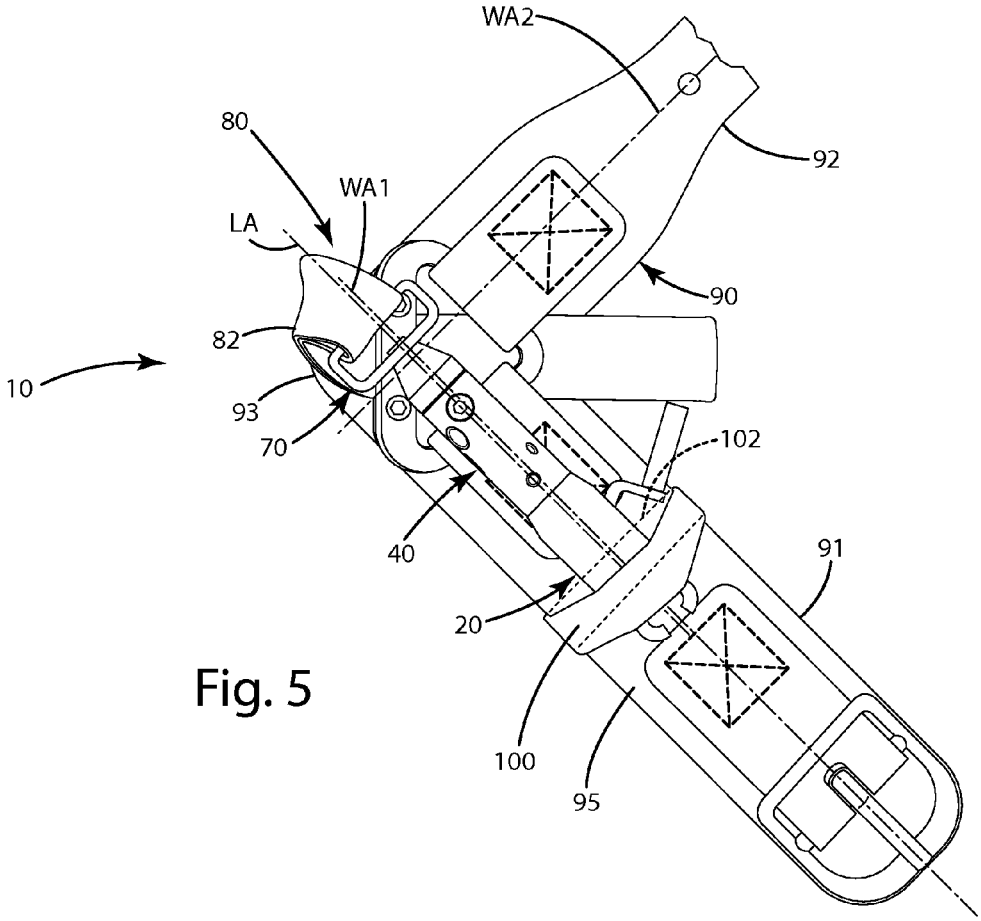
FIG. 5 is a top view of the release in a stowed mode.

A current embodiment of the archery release is shown in FIGS. 1-3 and generally designated 10. The release 10 generally includes a release body 20 having a longitudinal axis LA, first and second moveable jaws 50A and 50B, and a trigger 60. The release body 20 can be joined or integral with a first adjuster 40 which, as illustrated, is a rigid length adjuster. The rigid length adjuster can be joined or integral with an adjuster linking element 70, and optionally can swivel relative thereto. The adjuster linking element 70 can be further joined with a second adjuster 80 which, as illustrated, is a flexible length adjuster 80 including a tether 82. The tether 82 can be further joined with a second adjuster adjustment mechanism 84, or more generally with the wrist strap 90. The release can include a retainer element 100 that is configured to secure the release body 20 or a portion thereof in a generally stowed mode as shown in FIG. 5, out of the way when an archer is engaged in other activities.

The release can be used to assist the archer in drawing and releasing the bowstring 101. When the release is a closed position, as shown in FIG. 1, and used to draw the bowstring 101, the bowstring 101 is captured in one or both of the bowstring notches 52. The release 10 can be actuated from a closed position (FIG. 1) to an open position (FIGS. 2, 3) by an archer engaging and actuating the trigger 60.

The release can be operated to adjust the overall distance D of the release body, and/or its components, such as the moveable jaws, bowstring notch, trigger and/or the like from the wrist strap to fit the archer. For example, the first adjuster 40 and the second adjuster 80 can be individually and selectively configurable to establish the overall distance D between the wrist strap and the release body 20 and/or its components, such as, the bowstring notch 52.

Figure 4:
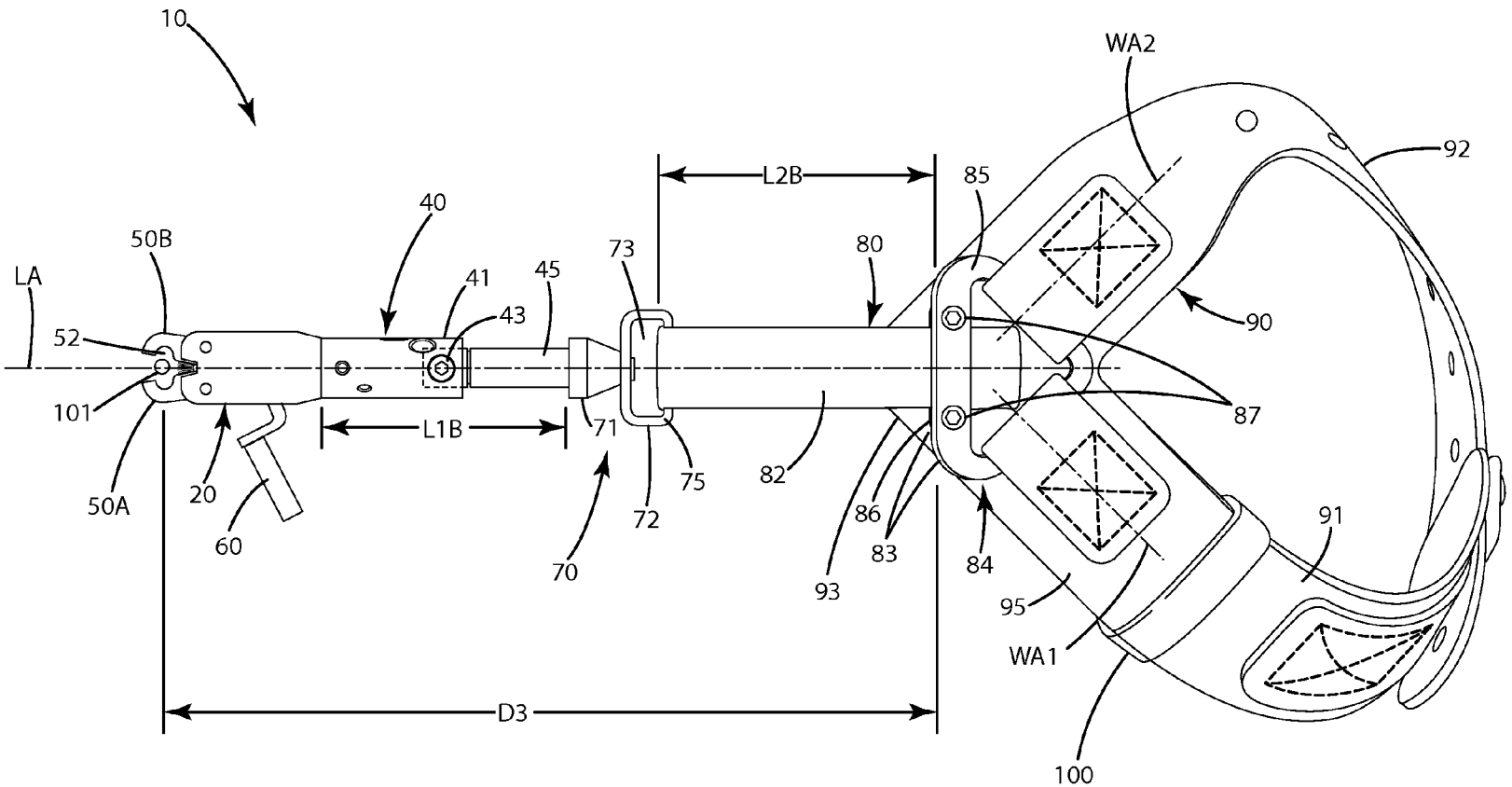
FIG. 4 is a top view of the release with a rigid adjuster in an extended mode and a flexible adjuster in an extended mode.

The release 10 can be extended from a generally retracted mode having an overall distance D between the wrist strap and bowstring notch shown in FIG. 1 to one or more exemplary extended modes, shown in FIG. 3, where the overall distance D is increased to distance D1, and in FIG. 4, where the overall distance D is increased to distance D2. To do so, the first adjuster 40 can be extended from a first length L1A to a second length L1B, greater than the first length. Optionally, the length of the first adjuster 40 can be adjusted incrementally to set lengths due to the fixed nature of the adjustment mechanism of that adjuster, as described below. Additionally or alternatively, the second adjuster 80 can be extended from a first length L2A to a second length L2B, greater than the first length. Optionally, the length of the second adjuster 80 can be variably adjusted to an infinite number of lengths, due to the nature of the engagement of the tether with the adjustment mechanism of that adjuster, as described below.

The release 10 can be operated to convert the release 10 from an extended mode to a stowed mode. As shown in FIG. 5, a retainer element 100 can form a retaining area 102 in which the release body 20 can be inserted and/or positioned. The retainer element 100 can engage the release body 20 and secure it generally to the wrist strap 90 so that it remains generally out of the way of the archer while the archer is engaged in some activity, other than drawing an archery bow with the release 10.

As used herein, "bowstring" refers to an actual bowstring of an archery bow and any device or component adapted to join with a bowstring of an archery bow and aid an archer in drawing or releasing the bowstring, including rope loops, which are attached to the bowstring above and below the location where an arrow nock rests, and receivers, for example, a metal loop or partial loop that is joined with the bowstring above and below, or only above, or only below the location where the arrow nock rests on the bowstring.

As used herein "archery bow" refers to any compound bow, recurve bow, long bow, crossbow or any other device that propels or is capable of propelling an arrow, bolt or other similar projectile.

Further, although the releases illustrated and described herein are generally two jaw, dual caliper wrist strap releases, the constructions herein are well suited for any other type of archery release including, but not limited to, single caliper, single jaw releases, rope releases, back tension releases, thumb releases, plunger releases, pinky releases, releases with or without wrist straps, hunting releases, target releases and the like.

II. Components

Referring to FIGS. 1-6 the components of the release 10 will now be described in detail. The release body 20 is generally elongate and includes moveable jaws 50A, 50B and a trigger 60. The jaws and trigger can be positioned in a recess 24 sufficiently sized to house all or a portion of these and other components of the release. The release body 20 can further define apertures to accommodate various pivot elements, such as pins, to join the trigger 60 and jaws 50A, 50B with the body 20 as desired.

The moveable jaws 50A and 50B can be constructed in a variety of configurations. In general, a suitable construction enables the movable jaws to move away from one another, or more generally it enables at least one jaw to move to release the bowstring from the bowstring notches 52. With reference to FIG. 2, the movable jaws can be pivotally mounted via pivot elements 55 to the release body 20. At a rearward portion 53, a roller (not shown) can be joined with the movable jaw 50B. In general, the roller can engage a sear (not shown) of the trigger 60. A variety of other elements can be substituted for the roller, such as ball bearings, non-rotating elements, sliding elements or any structure that enables the movable jaws 50A and 50B to open.

As shown in FIG. 1, the movables jaws 50A and 50B define bowstring notches 52. The bowstring notches can include a curvilinear, planar or other smooth surface configured to minimize wear on a bowstring. The bowstring notches can be disposed along or can face the longitudinal axis LA of the release body 20. In general, each notch can be U or V shaped opening or recess defined by the movable jaws 50A, 50B, generally configured to capture at least a portion of the bowstring 101.

Between the movable jaws, or optionally the release body 20, a bias member 59, such as a coil spring, a leaf spring, a rubber or other elastomeric element, can be positioned to urge the movable jaws open when the trigger 60 is actuated from a holding mode to a triggered mode. The bias member 59 can be located forward or rearward of the pivot pins 55 to assist in urging the movable jaws open. Other mechanisms for performing similar or different movement can be substituted as desired.

With reference to FIGS. 2 and 3, the release body 20 can include a trigger 60 which extends from the body and is accessible by an archer with one of the archer's digits, for example, an index finger or a thumb depending on the desired configuration. The trigger 60 pivots about a pivot pin (not shown) joined with the jaw 50B. The trigger can include a trigger adjustment element (not shown) which, for example, can be a set screw that is threadably engaged with the trigger. The trigger adjustment element can be threaded inward or outward with respect to the trigger 53 to adjust the sensitivity of the trigger pull.

The release 10 and its various components can be constructed from a variety of materials, for example, metal, such as steel, stainless steel and aluminum, as well as other synthetic materials such as polymers, and any combination of the foregoing. Further, the release 10 and its components can be treated with special processes, for example, anodizing, dipping or filming to provide the release and its components with a desired finish and appearance.

As shown in FIGS. 1 and 2, the release body 20 can include a longitudinal axis LA which generally extends the length of the release body 20. In general, this longitudinal axis LA typically can be aligned with and/or parallel to the forward travel path of a bowstring 101 as it is released from the release 10. Of course, in some circumstances, the longitudinal axis LA may not be perfectly aligned with the bowstring travel path, depending on the configuration of the bowstring and the archery bow to which it is attached.

The release body 20 can be joined with or generally can include as an integral portion thereof a first adjuster 40. This first adjuster 40 can be in the form of a rigid structure including incrementally placed adjustment features that enable this adjuster to be incrementally adjusted to fixed, preselected lengths, rather than adjusted to a any one of infinite variable lengths, as with the second adjuster described below. The first adjuster 40 can include a first connector element 41 and a second connector element 42. The first connector element 41 can be in the form of an outer adjustment element of a tubular construction, and the second connector element 42 can be in the form of a inner adjustment element in the form of a post. When in the form of a tubular element, the first connector element can be integrally formed with the release body and/or its components. The second connector element 42, when in the form of a post, can be joined and/or integral with the adjuster linking element 70 as described in further detail below. The first connector element 41 and the second connector element 42 can be telescopingly engaged with one another so that when moved relative to one another, the first connector element 41 and second connector element 42 can telescope inward and outward, relative to or toward and away from one another, thereby changing the overall length of the first adjuster. Optionally, the first connector element 41 and the second connector element 42 can be aligned and in parallel with the release body access LA.

The first connector element 41 can define a plurality of holes 45 set at incremental distances from one another in a fixed rigid structural relationship relative to one another. Some of the holes 45 can be threaded, while on opposing sides of the adjuster the holes may be open to receive the head of a fastener 43. Optionally, the plurality of holes 45 can be in a spiral orientation around the adjuster 40 as illustrated in FIGS. 1-5. Alternatively, the plurality of adjuster holes can be staggered, as shown in the alternative embodiment of FIG. 7 so that on one side of the release, holes 445A sized to accommodate for the head of the fastener 443 are alternated with holes 445B that accommodate the threaded portion of the fastener 443.

Returning to FIGS. 1-3, the second connector element 42, shown as a post, can define a primary hole 44 that is selectively alignable with any one of the plurality of holes 45 defined by the first connector element. The fastener 43 can be positioned through the plurality of holes and generally joined with the outer adjustment element and further placed through the aligned primary hole 44 to secure the first connector element 41 to the second connector element 42. One suitable construction suitable for the first adjuster is described in U.S. Pat. No. 5,596,977 to Scott, which is hereby incorporated by reference. Of course, other constructions may be used as desired.

The components of the first adjuster 40, and optionally the adjuster linking element 70, all can be constructed of a generally rigid and inflexible material. Suitable material include metals, hard polymers, composites and combinations of the foregoing. When the first adjuster 40 is constructed of rigid materials and defines fixed distance incrementally spaced holes, such as that shown in FIGS. 1-5, the adjustments of the first adjuster 40 generally can be incremental, that is, the length of the first adjuster 40 can be set in specific predefined increments, for example, 1/16 inch, 1/8 inch, 1/4 inch, 1/2 inch or other fixed lengths as desired. Of course, where the first adjuster 40 includes connector elements constructed of rigid materials, but where the connector elements are threaded to one another with threads or some other infinitely adjustable construction, the archer can adjust the length of the first adjuster to any desired one of infinite lengths.

Figure 6:
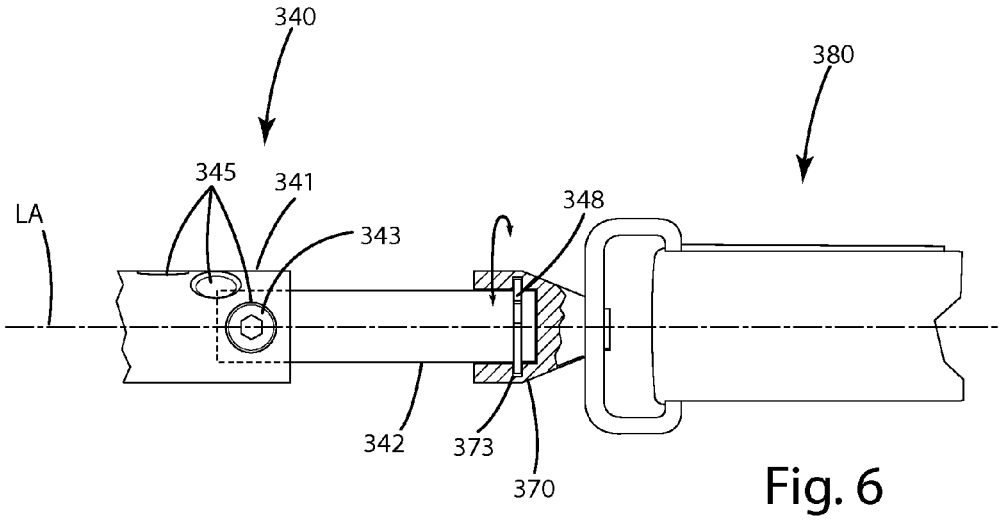
FIG. 6 is a partial sectional view of an adjuster linking element of the release.

Optionally, the first adjuster 40 can be configured to enable the release body 20 to swivel or rotate relative to the adjuster linking element 70 and/or the second adjuster 80 and/or the wrist strip 90. For example, as shown in FIG. 2, the second connector element 42 in the form of the post can include a swivel end 46 that swivels in the directions of rotation R about the remainder of the post 47. This can enable the release body to generally rotate relative to other components of the release 10. Other alternative constructions can be substituted for the aforementioned rotating construction. For example, as shown in FIG. 6, the second connector element 342, generally in the form of a post, can be fixedly mounted with a fastener 343 in a selected one of the holes 345 to the first connector element 341. A washer, c-clip, or other protrusion 348 can be joined or integral with the post 342, and this protrusion can be selectively positioned in a recess or groove 373 of the adjuster linking element 370. The second connector element, for example the post 342, and more generally the first adjuster 340, and an associated release body, can thereby rotate relative to the adjuster linking element 370, the second adjuster 380, and/or any associated wrist strap.

As shown in FIGS. 2 and 3, the release 10 can include an adjuster linking element 70. The adjuster linking element 70 can be joined with the second connector element 42 of the first adjuster 40. The adjuster linking element 70 also can be joined with the second adjuster 80, and more particularly the tether 82 of the second adjuster 80.

The adjuster linking element 70 can generally include a first end 71 and a second end 72. The first end 71 can be attached to the first adjuster 40 and more particularly the second connector element 42 of the first adjuster 40. The second end 72 can be joined with the second adjuster 80. The adjuster linking element 70 can be generally aligned along the longitudinal axis LA of the release body 20. As mentioned above, the adjuster linking element 70 and/or the second adjuster 80 can be configured so that these elements swivel or rotate relative to the release body 30 and/or the first adjuster 40.

The adjuster linking element 70 shown in FIGS. 2 and 3 can define a tether hole 73. This tether hole can be sized to accommodate the tether 82 which can be placed in and/or through it. As shown, the tether 82 generally loops around an adjuster linking element bar 75 and through the adjuster linking element tether hole 73.

Figure 7:
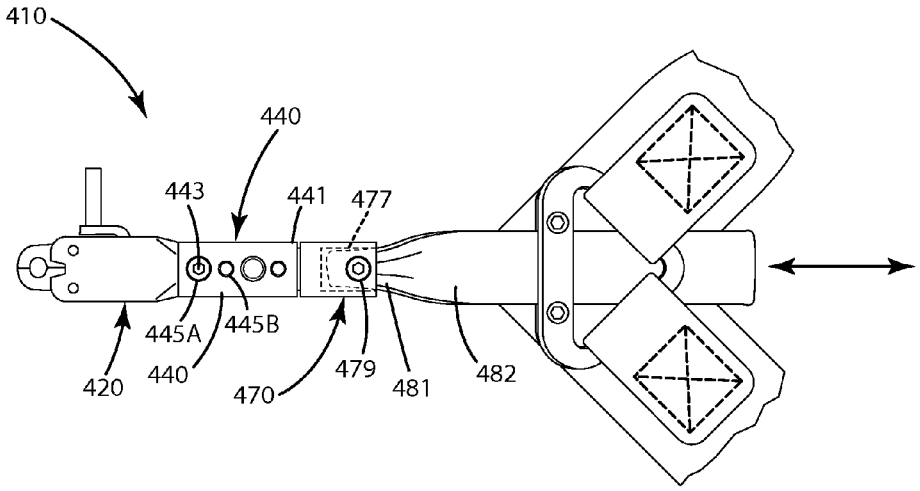
FIG. 7 is a top view of a second alternative embodiment of the release.

The adjuster linking element generally can be located between the first adjuster 40 and the second adjuster 80, and further generally between the release body 20 and the wrist strap 90. Optionally, the adjuster linking element 70 can be modified as desired. For example, instead of having the structure as illustrated in FIGS. 2 and 3, the adjuster linking element can be in the form of a hole defined through a portion of the first adjuster. Optionally, as shown in FIG. 7, the adjuster 440 can define a hole 477 into which a free end 481 of the tether 482 is placed. A fastener 479 or clamp (not shown) can be in communication with the hole 477. This fastener or clamp can clampingly engage or otherwise secure the end 481 of the tether 482 to the first adjuster 440.

The second adjuster 80 as illustrated in FIGS. 1-4 generally includes a tether 82 and a second adjuster adjustment mechanism 84 which is configured to selectively engage the tether. The tether 82, also referred to as a flexible tether herein, can be aligned along and/or parallel to the longitudinal axis LA of the release body 20 when the release 10 is used to hold a bowstring 101.

The tether 82 can be generally flexible, that is, it can flex and/or bend relatively easily, optionally under the weight of the release body 20, to enable the orientation of the release body 20 to be altered relative to the wrist strap 90, and it can provide attachment to the release body 20. Although the tether is illustrated in the form of a web, it can be in the form of a cord, rope, strap, wire, or some other flexible connector. Such a connector can also be adjustable to enable the distance between the release body 20 and the wrist strap 90 to be varied and thereby accommodate the personal preferences and/or physical anatomy of an archer. One example of an adjuster suitable for use as the second adjuster 80 is disclosed in U.S. Pat. No. 5,850,825 to Scott, which is hereby incorporated by reference.

The second adjuster 80 with its flexible tether 80 can enable the release body 20 and/or first adjuster 40 to be moved in a variety of configurations. For example, as shown in FIG. 5, due to the flexible nature of the flexible tether 82 the release body 20, the first adjuster 40 and the adjustable linking element 70 can be folded back.

As illustrated in FIG. 2, the tether 82 can be folded over on itself and looped through the tether hole 73 defined by the adjuster linking element 70. The tether 82 can be clamped or otherwise held within the adjustment mechanism 84, with first and second portions of the tether 82 overlapping one another therein. Generally, the adjustment mechanism 84 can clamp or hold the tether or portion thereof.

Optionally, the adjustment mechanism 84 of the second adjuster 80 can include opposing clamping members 83, one of which can be in the form of a ring or connector component 85 that is secured to the remainder of the wrist strap 90. This connector component 85 can engage a portion of the tether 82. As shown in FIG. 2, the adjustment mechanism 84 can also include a secondary clamp element 86 that engages the flexible tether 82. More particularly, the tether 82 can be positioned between the connector component 85 and the secondary connector element 86. The connector component 85 and the secondary connector element 86 can be drawn toward one another via tightening of the fasteners 87. In turn, this clamps or otherwise firmly sandwiches the flexible tether 82 between these components. By loosening these components, and the adjustment mechanism 84 in general, the archer can adjust the length of the second adjuster 80 to any one of a number of infinite lengths. By tightening the adjustment mechanism 84, the archer can fix a desired length and in turn fix the overall distance D between the wrist strap and the release body and its components, for example, the bowstring notches 52 as shown in FIG. 1. Optionally, the second adjuster 80 can be joined with the apex 93 of the wrist strap 90. One suitable construction for the second adjuster 80 is disclosed in U.S. Pat. No. 7,278,415 to Scott, which is hereby incorporated by reference in its entirety.

FIGS. 1-4 generally illustrate a release 10 where the first adjuster 40 is positioned between the release body 20 and the adjuster linking element 70, and the second adjuster 80 is positioned between the adjuster linking element 70 and the wrist strap 90. Optionally, the order of the adjusters can be modified. For example, the first adjuster 40 and the second adjuster 80 can be reversed, with the tether being connected between the release body 20 and the adjuster linking element 70, and the rigid components of the first adjuster 40 being connected between the adjuster linking element 70 and the wrist strap 90. Further, the number of rigid adjusters and flexible adjusters can be modified, depending on the particular application.

The wrist strap 90 of the release 10 can be constructed of a generally flexible material and adapted to wrap around an appendage, such as a wrist, a forearm, and/or a hand of an archer. The wrist strap 90 can be constructed from leather, plastic, fabric, and/or other materials or composites depending on the desired look and feel of the wrist strap. The wrist strap 90 can include a first portion 91 and a second portion 92, generally joined with one another at an apex 93 of the strap 90. These portions can be configured to attach with one another when wrapped around the appendage of an archer, for example, a wrist, forearm or hand of an archer. Generally, when the wrist strap 90 is attached to the archer, it can form a tear drop shaped loop as shown in FIGS. 3-4. With this construction, the release body and adjusters generally can be forward facing from the apex 93 of the wrist strap 90. These components can be further oriented relative to the appendage and/or hand of the wearer based on preference.

The first portion 91 and second portion 92 of the wrist strap 90 can define a first wrist strap portion axis WA1 and a second wrist strap portion axis WA2, respectively. These axes can be transverse to one another and intersect at, or near, the apex 93 of the wrist strap 90. When the archery release is used to hold and/or otherwise restrain a bowstring 101, the wrist strap axis WA1, WA2 also can be transverse the longitudinal axis LA of the release body 20. In this configuration, the longitudinal axis LA of the release body 20 also can pass through the apex 93 of the wrist strap 90. Of course, as described herein, in other configurations of the release 10, the longitudinal axis LA can be aligned with and/or parallel to one or more of the wrist strap axis WA1, WA2.

Although the wrist strap 90 is illustrated as a buckle-type wrist strap, other wrist strap configurations can be substituted in the archery release 10. For example, one other suitable wrist strap is illustrated in U.S. Pat. No. 5,595,167 to Scott, which is hereby incorporated by reference.

As explained above, the archery release 10 can include a release body 20, a wrist strap 90, and a retainer element 100. The retainer element 100 can be constructed from a variety of materials. For example, the retainer element can be constructed from resilient material so that it can be stretched and return generally to its original shape and/or form. Suitable resilient materials include elastomeric materials, such as rubber, elastic fabrics, silicone, thermoplastic rubber, and other resilient and/or flexible materials.

The retainer element 100, optionally can be in the form of a band which generally circumferentiates or surrounds a portion of the wrist strap 90. As illustrated in FIGS. 1 and 5, the retainer element 100 can circumferentiate the first wrist strap portion 91. The retainer element 100 can be placed distal from the apex 93 of the wrist strap. Of course, the retainer element 100 can be placed on the second wrist strap portion 92 or other portion of the wrist strap portion 90 as desired.

Optionally, the retainer element 100 can be positioned adjacent the upper surface 95 and lower surface 96 of the wrist strap. Further optionally, the retainer element can be transverse to one or both of the first and second wrist strap axis WA1, WA2. As shown in FIG. 5, the retainer element 100 also can circumferentiate and/or be transverse to the wrist strap axis WA1.

The retainer element 100 generally can form a retaining area 102 where the retainer element is an elastomeric material. This retaining area 102 can be formed by the archer stretching and/or pulling on the a portion of the retainer element 100. This retaining area 102 can be of sufficient size to accommodate the release body 20, or its components, and/or other portions of the release, when inserted in and or through the retaining area 102. The retainer element 100 can safely and consistently position the release body 20 in proximity to the wrist strap 90 so that the release body and/or adjuster components do not interfere with other activities of the archer when the release is not in use.

Figure 8:
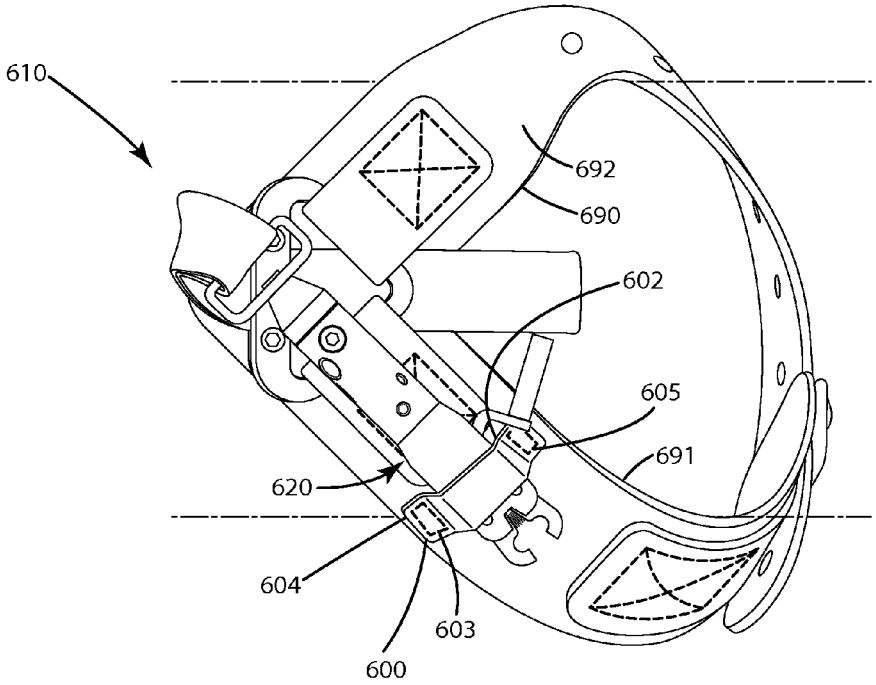
FIG. 8 is a top view of a third alternative embodiment of the release in a stowed mode.

In general, the release 10 and retainer element 100 can be used in the following manner. The release 10 can be attached to an archer, for example, by attaching the wrist strap 90 to an archer's appendage. When attached, the wrist strap 90 can generally form a tear shaped loop around the appendage of the archer as shown in FIGS. 4 and 8. When the release is used for holding and/or drawing a bowstring 52, the release 10 is generally configured as shown in FIG. 1. There, the longitudinal axis LA is generally transverse to both the wrist strap first portion axis WA1 and wrist strap second portion axis WA2. These axes WA1, WA2, also are transverse to one another. When used in this mode, the release is generally said to be operated in a release mode.

When the archer no longer desires to use the release to engage a bowstring, the release 10 can be converted to a stowed mode. To do so, the archer can engage the retainer element 100 and form of retaining area between the retainer element 100 and the wrist strap 90. The archer can insert the release body 20 and/or components thereof and/or the first adjuster 40 in the retaining area 102, under the retainer element 100 and/or generally between the retainer element 100 and the wrist strap 90, as shown in FIG. 5.

In so doing, the tether 82 can be reconfigured, for example, folded or otherwise moved so that the longitudinal axis LA of the release body 20 is reoriented. As an example of this reorientation, the longitudinal axis LA can be oriented generally parallel and/or aligned with the first portion wrist strap axis WA1. The longitudinal axis LA also can be configured transverse to the second wrist strap portion WA2. Of course, if desired, the retainer element 100 can be placed on the second wrist strap portion 92 so that the longitudinal axis LA aligns with the second wrist strap axis WA2 and is transverse to the first wrist strap axis WA1.

With the release body 20 and/or its components positioned in the retaining area 102, the retainer element 100 can be released to secure or trap the release body 20 between the retainer element 100 and the wrist strap first portion 91 and/or wrist strap 90, and specifically between the retainer element 100 and the upper surface 95 of the wrist strap 90. In this configuration, the release is in a stowed mode, with the release body 20 stowed between the retainer element and the wrist strap, generally constrained by the retainer element 100. Where the retainer element 100 is in the form of a resilient material, for example, an elastomeric band, the aforementioned procedure of forming the retainer element 100 can be conducted by simply stretching the band 100 away from the wrist strap upper surface 95, inserting the release body 20 within the formed retaining area 102, and then releasing the elastomeric band so that it reduces to its former dimension, thereby holding the release body 20 and its components adjacent the wrist strap 90.

An alternate construction of the retainer element is shown in FIG. 8. There, the retainer element 600 is generally in the form of a strap forming a holster 602. The sides, edges or ends 604, 605 of the straps 600 can be stitched down with stitching 603. Alternatively, those ends 604, 605 can be cemented, adhered, welded, riveted, fastened or otherwise joined with the wrist strap 690. This holster 602 can be sized so that the release body 620 fits snugly within it. Optionally, the strap 604 can be constructed from a resilient material, for example, a portion of an elastomeric band, to provide some level of stretch to that component. In this embodiment, the retainer element 600 can be joined with the first wrist strap first portion 691, but of course, it could be attached to the wrist strap second portion 692. Further optionally, another retainer element 600 can be positioned on the second wrist strap portion 692.

III. Methods of Assembly and Use

In general, components of the release, such as the release body, first adjuster and adjuster linking element can be molded, machined and/or extruded to obtain their desired configuration. These components can also be treated with special processes as described above to provide a desired finish. Other components, such as the wrist strap, flexible tether and retainer element can be molded, extruded, die cut, and/or sewn to construct them. With the components constructed, the release 10 is assembled.

To assemble the release, the components of the release body 20 are joined therewith. The various components of the release body can be ground or filed to remove to any excess material and lubricated to optimize movement and provide crisp actuation as desired. The first and second connector elements 41 and 42 of the first adjuster 40 are assembled and joined. The adjuster linking element 70, joined with the second connector element 42, can be positioned so the flexible tether 82 of the second adjuster 80 can be placed through the tether hole 73 of the adjuster linking element 70. The tether 82 also can be joined via the adjustment mechanism 84 to the wrist strap 90 to secure the second adjuster 80, the adjuster linking element 70, first adjuster 40, and the release body 20 to the wrist strap 90.

To operate the release, an archer places the wrist strap 90 on the archer's wrist, generally wrapping the first and second wrist strap portions 91, 92 around the archer's appendage and connecting those wrist strap portions so that they form a generally tear drop shape (FIG. 3), with the apex 93 of the wrist strap 90 facing forward toward the archer's fingers.

The archer actuates the release so the moveable jaws 50A, 50B are in the open position shown in FIG. 2. The archer then positions these jaws adjacent the bowstring 101 of an archery bow which the archer intends to draw with a release 10. The release 10 grasps the bowstring 101 with the moveable jaws 50A, 50B so that the bowstring is within the notches 52. The moveable jaws 50A, 50B are then moved toward one another to capture the bowstring 101, as shown in FIG. 1. The archer then draws the bowstring 101 to a drawn state with the assistance of the release 10. As the release is configured in this release mode, the longitudinal axis LA of the release body 20 is generally transverse to the wrist strap axes WA1, WA2. The release 10 also is said to be in a generally extended, or in use, mode (as opposed to a stowed mode as described below). After the archer satisfactory aims the bow, the archer actuates the release with a trigger 60 to release the bowstring 10 from the moveable jaws 50A and 50B.

The release also can be operated to precisely and consistently configure the release to fit the archer. For example, an archer can precisely and consistently alter or adjust the overall distance D between the release body and/or its components, such as the bowstring notch 52 and the wrist strap 90 of the release 10. This fits the release to the archer's hand size, wrist size, draw length, or other physical characteristics.

As an example, the archer can adjust the overall distance D between the wrist strap and the bowstring notch 52 to other overall distances D2 or D3. To do so, the archer can adjust the length of the first adjuster 40 and/or the second adjuster 80. To adjust the length of the first adjuster 40, the archer can begin with the first length L1A, as shown in FIG. 1. The archer can remove the fastener 43 from the first adjuster 40 and slide the first connector element 41 outward relative to the second connector element 42 so that these elements telescope with respect to one another. The archer can select a second hole from the plurality of holes 45 and align it with the primary hole 44 of the second connector element 42. The archer can place the fastener 43 through the second hole to establish a second length L1B of the release, as shown in FIG. 3. As shown, L1B can be greater than L1B. Of course, the archer can also move the first and second connector elements to shorten the length of the first adjuster element 40 as desired. Generally, the adjustment of the first adjuster 40 establishes incremental pre-defined lengths of the adjuster 40 due to the fixed positions of the respective plurality of holes defined by the first connector element 41.

The archer additionally and/or alternatively can adjust the length of the second adjuster 80. For example, if the archer desires to increase the length of the second adjuster 80, the archer loosens the adjustment mechanism 84 at the wrist strap 90 and pulls the release body 20 so that the overall distance D from the wrist strap increases. This, in turn increases the length of the flexible tether 82 between the adjuster linking element 70 and the wrist strap 90 and/or adjustment mechanism 84, generally from L2A shown in FIGS. 1 and 3, to L2B shown in FIG. 4. The archer can then re-engage the adjustment mechanism to secure and fix the newly adjusted length of a second adjuster 80. Although an increase in length of the second adjuster 80 is illustrated transitioning from L2A to L2B, the archer can shorten the length using a reverse procedure.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The embodiments of the invention in which an exclusive property or privilege is claimed are defined as follows:

1. An archery release comprising:

a release body having a longitudinal axis;

a movable jaw joined with the release body, the movable jaw movable between a closed position and an open position, the movable jaw defining a bowstring notch configured to restrain a bowstring in the closed position;

a wrist strap configured to engage an archer;

an adjuster linking element located between the wrist strap and the release body;

a first adjuster joined with the release body, the first adjuster including a rigid connector element defining a plurality of holes corresponding to a plurality of incremental distances between the bowstring notch and the adjuster linking element, the first adjuster including a fastener selectively positionable through at least one of the plurality of holes to establish a preselected incremental distance between the bowstring notch and the adjuster linking element; and a second adjuster joined with and positioned between the adjuster linking element and the wrist strap, the second adjuster including a flexible tether configured to establish a preselected variable distance between the adjuster linking element and the wrist strap, whereby the first adjuster and the second adjuster are adjustable to select both a preselected incremental distance and a preselected variable distance to fit the release to the archer.

2. The archery release of claim 1 wherein the first adjuster includes a tubular adjustment element and an adjustment post, the adjustment post telescopingly positioned in the tubular adjustment element, wherein the tubular adjustment element is the rigid connector element and defines the plurality of holes corresponding to the plurality of incremental distances between the bowstring notch and the adjustable linking element, wherein the adjustment post defines a primary hole configured to be aligned with individual ones of the plurality of holes.

3. The archery release of claim 1 wherein the adjuster linking element includes a tether hole through which the flexible tether is positioned.

4. The archery release of claim 3 wherein the first adjuster includes an inner adjustment element and an outer adjustment element telescopingly joined with one another, wherein at least one of the inner adjustment element and the outer adjustment element are rotatably joined with the adjuster linking element so that the release body can swivel relative to the flexible tether.

5. The archery release of claim 1 wherein the rigid connector element is telescopingly engaged with another rigid connector element and rotatable relative to the adjuster linking element.

6. The archery release of claim 1 comprising a retainer element joined with the wrist strap, the retainer element constructed from an elastomeric material, wherein the release body, adjuster linking element, first adjuster and second adjuster are configurable in an extended mode during use of the release and a stowed mode when the release is not in use, wherein the retainer element secures at least one of the release body, the adjuster linking element, the first adjuster, and the second adjuster proximate the wrist strap in the stowed mode.

7. The archery release of claim 1 wherein the flexible tether aligns in parallel with the release body longitudinal axis when the release is used to draw a bowstring.

8. An archery release comprising:

a release body;

a wrist strap configured to engage an archer;

an adjuster linking element located between the wrist strap and the release body;

a first adjuster including an inner adjustment element and an outer adjustment element telescopingly joined with one another and configured to establish a preselected length of the first adjuster, the first adjuster joined with the adjuster linking element;

a second adjuster, distal from the first adjuster, the second adjuster including a flexible tether configured to establish a preselected length of the second adjuster, the second adjuster joined with the adjuster linking element;

wherein the first adjuster and the second adjuster are both positioned between the release body and the wrist strap, wherein the preselected length of the first adjuster and the preselected length of the second adjuster are individually and separately configurable to establish a distance between the wrist strap and the release body so as to fit the archery release to an archer.

9. The archery release of claim 8 wherein the inner adjustment element and the outer adjustment element are each constructed from metal, and wherein the second adjuster includes a flexible tether.

10. The archery release of claim 8 comprising a fastener, wherein at least one of the inner adjustment element and the outer adjustment element define a plurality of holes, wherein the other of the at least one of the inner adjustment element and the outer adjustment element defines a primary hole, wherein the fastener is selectively positionable through one of the plurality of holes and the primary hole to establish the preselected length of the first adjuster.

11. The archery release of claim 8 wherein the adjustable linking element defines a tether hole through which the flexible tether is positioned.

12. The archery release of claim 8 wherein the adjustable linking element includes a fastener that clampingly engages the flexible tether to join the flexible tether with the adjustable linking element.

13. The archery release of claim 8 comprising a retainer element joined with the wrist strap, wherein the release body, adjuster linking element, first adjuster and second adjuster are configurable in an extended mode during use of the release, and a stowed mode when the release is not in use, wherein the retainer element secures at least one of the release body, the adjuster linking element, the first adjuster, and the second adjuster proximate the wrist strap in the stowed mode.

14. The archery release of claim 8, wherein the wrist strap is joined with the flexible tether, wherein the flexible tether is located between the wrist strap and the adjuster linking element, wherein the flexible tether is joined with a first end of the adjuster linking element, wherein the first adjuster is joined with a second opposing end of the adjuster linking element, and wherein the first adjuster is located between the adjuster linking element and the release body.

15. An archery release comprising:

a release body;

a movable jaw defining a bowstring notch that is configured to restrain a bowstring, the moveable jaw joined with the release body;

a flexible tether joined with the release body;

a wrist strap forming a generally tear shaped loop when the wrist strap is attached to an archer the wrist strap including an apex joined with the flexible tether; and a retainer element joined with the wrist strap, wherein the release body is positionable in a release mode in which the moveable jaw is enabled to restrain the bowstring, or in a stowed mode in which the retainer element secures the release body to the wrist strap wherein the release body includes a release body longitudinal axis, wherein the wrist strap includes a first wrist strap portion having a first wrist strap portion axis, a second wrist strap portion having a second wrist strap portion axis, wherein the first wrist strap portion axis and the second wrist strap portion axis are transverse to one another approximate the apex, wherein the release body longitudinal axis is generally parallel with the first wrist strap portion axis, but is transverse to the second wrist strap portion axis, when the release body is in the stowed mode.

16. An archery release comprising:

a release body;

a movable jaw defining a bowstring notch that is configured to restrain a bowstring, the moveable jaw joined with the release body;

a flexible tether joined with the release body;

a wrist strap forming a generally tear shaped loop when the wrist strap is attached to an archer, the wrist strap including an apex joined with the flexible tether; and a retainer element joined with the wrist strap, wherein the release body is positionable in a release mode in which the moveable jaw is enabled to restrain the bowstring, or in a stowed mode in which the retainer element secures the release body to the wrist strap wherein the retainer element is an elastomeric band that circumferentiates at least a portion of the wrist strap, wherein the release body is located between the elastomeric band and the wrist strap when the release body is in the stowed mode.

17. The archery release of claim 16 wherein the wrist strap includes an upper surface and a lower surface, the lower surface adapted to contact the archer, wherein the elastomeric band wraps around the wrist strap so that it faces both the upper surface and lower surface of the wrist strap.

18. An archery release comprising:

a release body;

a movable jaw defining a bowstring notch that is configured to restrain a bowstring, the moveable jaw joined with the release body;

a flexible tether joined with the release body;

a wrist strap forming a generally tear shaped loop when the wrist strap is attached to an archer, the wrist strap including an apex joined with the flexible tether; and a retainer element joined with the wrist strap, wherein the release body is positionable in a release mode in which the moveable jaw is enabled to restrain the bowstring, or in a stowed mode in which the retainer element secures the release body to the wrist strap wherein the retainer element is constructed from an elastomeric material and is adapted to be stretched to a greater dimension so that the release body can be inserted between the wrist strap and the retainer element in the stowed mode.

19. The archery release of claim 18 wherein the retainer element is in the form of a strap joined with the wrist strap, the strap forming a holster within which the release body is located in the stowed mode.

20. A method for operating an archery release comprising:

providing an archery release including a release body, a moveable jaw joined with the release body, a flexible tether joined with the release body, and a wrist strap including an apex joined with the flexible tether;

attaching the wrist strap to an archer so the wrist strap generally forms a tear shaped loop around an appendage of the archer;

forming a retaining area between a retainer element and the wrist strap;

inserting the release body in the retaining area to secure the release body adjacent the wrist strap in a stowed mode, pulling a portion of the retainer element away from the wrist strap during said forming step.

21. A method for operating an archery release comprising;

providing an archery release including a release body, a moveable jaw joined with the release body, a flexible tether joined with the release body, and a wrist strap including an apex joined with the flexible tether;

attaching the wrist strap to an archer so the wrist strap generally forms a tear shaped loop around an appendage of the archer;

forming a retaining area between a retainer element and the wrist strap;

inserting the release body in the retaining area to secure the release body adjacent the wrist strap in a stowed mode, releasing the retainer element after said inserting step so that the retainer element captures the release body between the retainer element and the wrist strap to secure the release body in the stowed mode.

22. A method for operating an archery release comprising:

providing an archery release including a release body, a moveable jaw joined with the release body, a flexible tether joined with the release body, and a wrist strap including an apex joined with the flexible tether;

attaching the wrist strap to an archer so the wrist strap generally forms a tear shaped loop around an appendage of the archer;

forming a retaining area between a retainer element and the wrist strap;

inserting the release body in the retaining area to secure the release body adjacent the wrist strap in a stowed mode, wherein the retainer element is an elastomeric band, wherein the elastomeric band is placed transversely around a portion of the wrist strap, wherein the forming step includes pulling the elastomeric band away from the wrist strap.

23. The method of claim 22 comprising releasing the elastomeric band after the inserting step to capture the release body and secure the release body in the stowed mode.

* * * * *